United States Patent [19]

Metz

[11] Patent Number: 4,637,183

[45] Date of Patent: Jan. 20, 1987

[54] FRAME FOR DOOR OR WINDOW OPENING

[75] Inventor: Laurens Metz, Hilversum, Netherlands

[73] Assignee: Polynorm, N.V., Netherlands

[21] Appl. No.: 660,221

[22] Filed: Oct. 12, 1984

[30] Foreign Application Priority Data

| | | | |
|---|---|---|---|
| Oct. 13, 1983 | [NL] | Netherlands | 8303519 |
| Dec. 21, 1983 | [NL] | Netherlands | 8304390 |
| Dec. 21, 1983 | [NL] | Netherlands | 8304391 |

[51] Int. Cl.[4] ..... E06B 1/04

[52] U.S. Cl. ..... 52/217; 52/213; 49/504

[58] Field of Search ..... 52/204, 208, 211, 213, 52/217, 214; 49/505, 504

[56] References Cited

U.S. PATENT DOCUMENTS

| | | | |
|---|---|---|---|
| 2,851,757 | 9/1958 | Pender | 52/718 |
| 3,250,049 | 5/1966 | Sklar | 52/211 |
| 3,585,770 | 6/1971 | Maizler | 52/217 |
| 3,721,055 | 3/1973 | Jerchower | 52/217 |
| 3,810,999 | 1/1975 | Faudree | 52/211 |
| 4,014,146 | 3/1977 | Mascio | 52/211 |
| 4,179,849 | 12/1979 | Kuffner | 52/213 |

FOREIGN PATENT DOCUMENTS

| | | | |
|---|---|---|---|
| 1365376 | 5/1964 | France | 52/213 |
| 1560400 | 2/1969 | France | 52/217 |
| 908985 | 10/1962 | United Kingdom | 52/212 |

*Primary Examiner*—Henry E. Raduazo

*Attorney, Agent, or Firm*—Birch, Stewart, Kolasch & Birch

[57] ABSTRACT

A frame having a U-shaped cross-section is clamped at a wall rim bounding an opening in a wall by means of a clamping jaws. The clamping jaws are formed by a steel sheet bent over in its longitudinal direction and are profiled substantially throughout their lengths, so that with a small thickness of material the clamping jaws mainly derive their rigidity from their profile.

8 Claims, 18 Drawing Figures

FIG. 2
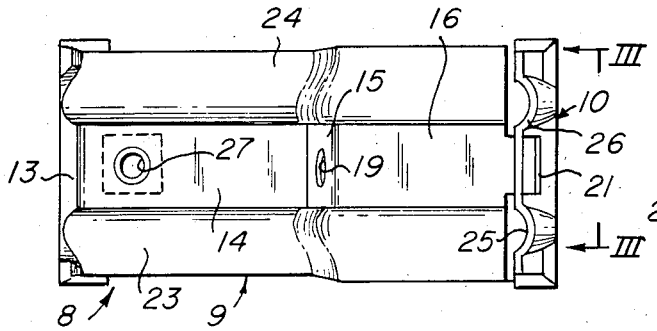
FIG. 4
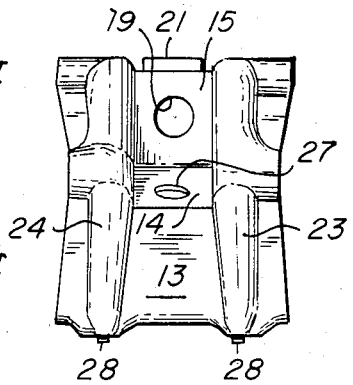
FIG. 1
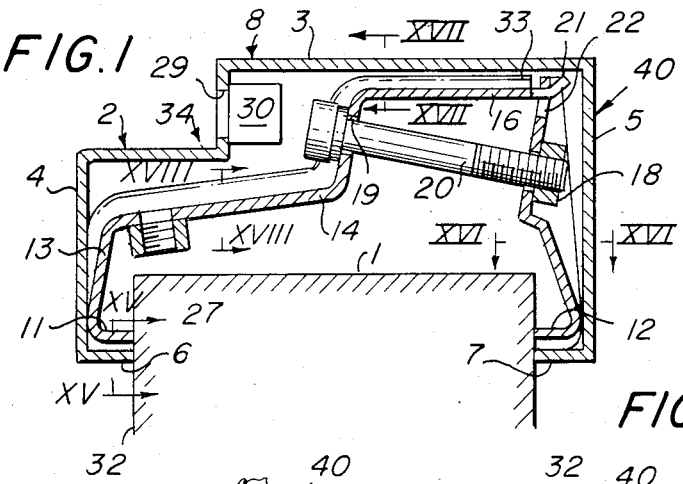
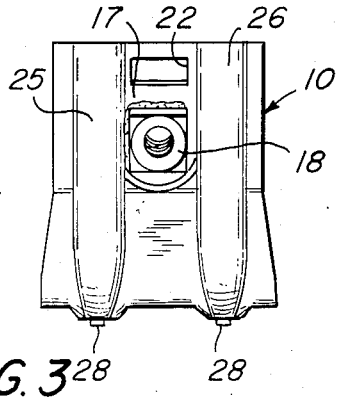
FIG. 3
FIG. 7
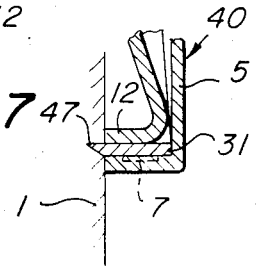
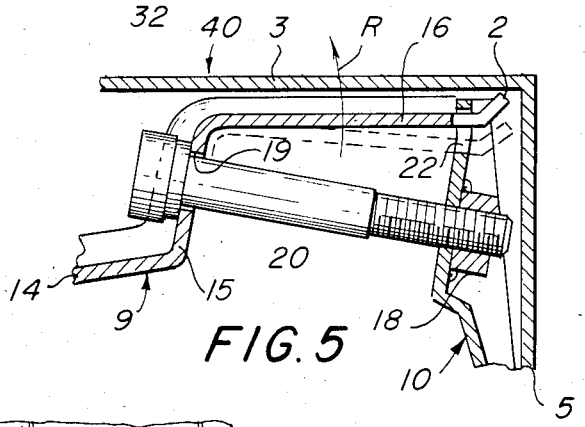
FIG. 5
FIG. 6
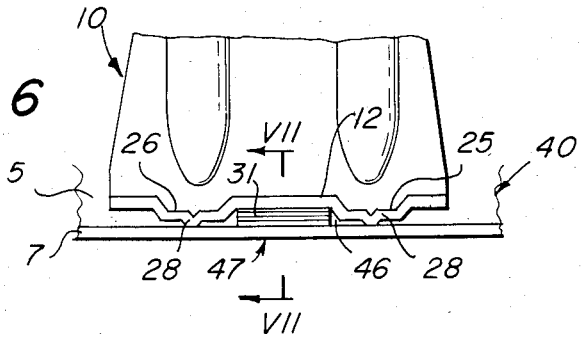

FRAME FOR DOOR OR WINDOW OPENING

The invention relates to a frame as defined in the heading of claim 1.

Such a frame is known from BE-A-089707. In this case the clamping jaws grip by their own spring force the bent-over rims of the frame profile. In the event of shocks and particularly of vibrations, the frame may shift in place with respect to the wall. The connection is so weak that a large number of clamps distributed along the circumference of the frame is required.

The invention provides such a strong clamp that by means of a few clamps distributed along the circumference of the frame a firm connection of the frame with the wall can be insured thanks to the characteristic feature defined in claim 1. Even the clamps themselves require little material because the clamping jaws can be made from thin steel sheet. This is preferably high-quality steel.

The invention furthermore provides a frame as defined in claim 2. In this case the profile of the frame element is not or only hardly loaded so that it can be made from thin-walled materials. The paumelle—and hence the door or the window—can be firmly secured through a clamp to a wall when a rugged clamping joint as claimed in claim 1 is used.

Preferred embodiments are described in claims 2 to 6.

Thanks to the fact that the starting material is a thin steel sheet, the clamping jaws can be readily welded to the frame profile. This provides a firm guard against displacement of the frame profile relative to the clamp. The invention thus provides a frame as claimed in claim 7. The profiled clamping jaws readily enable establishing a firm interconnection of a clamping jaw and a wing of a paumelle guarded against easy distortion by the profiled clamping jaw.

The above mentioned and further features of the invention are elucidated in the following description with reference to the drawings.

The drawings schematically show in

Figure 8:
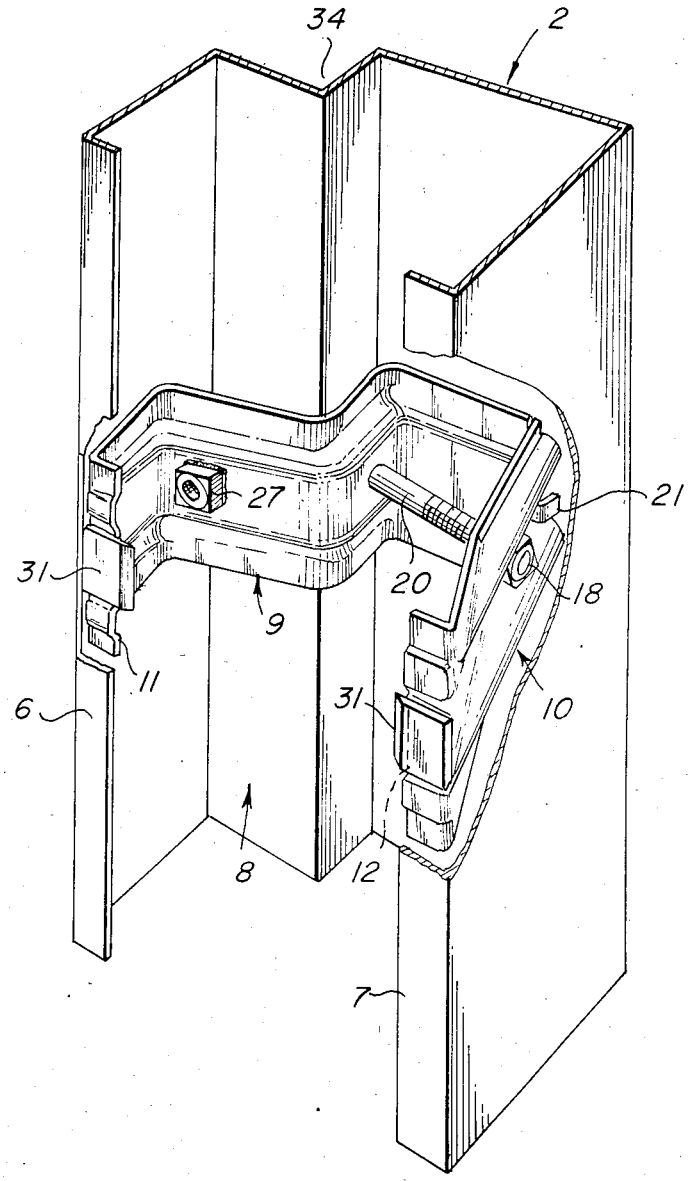
Figure 9:
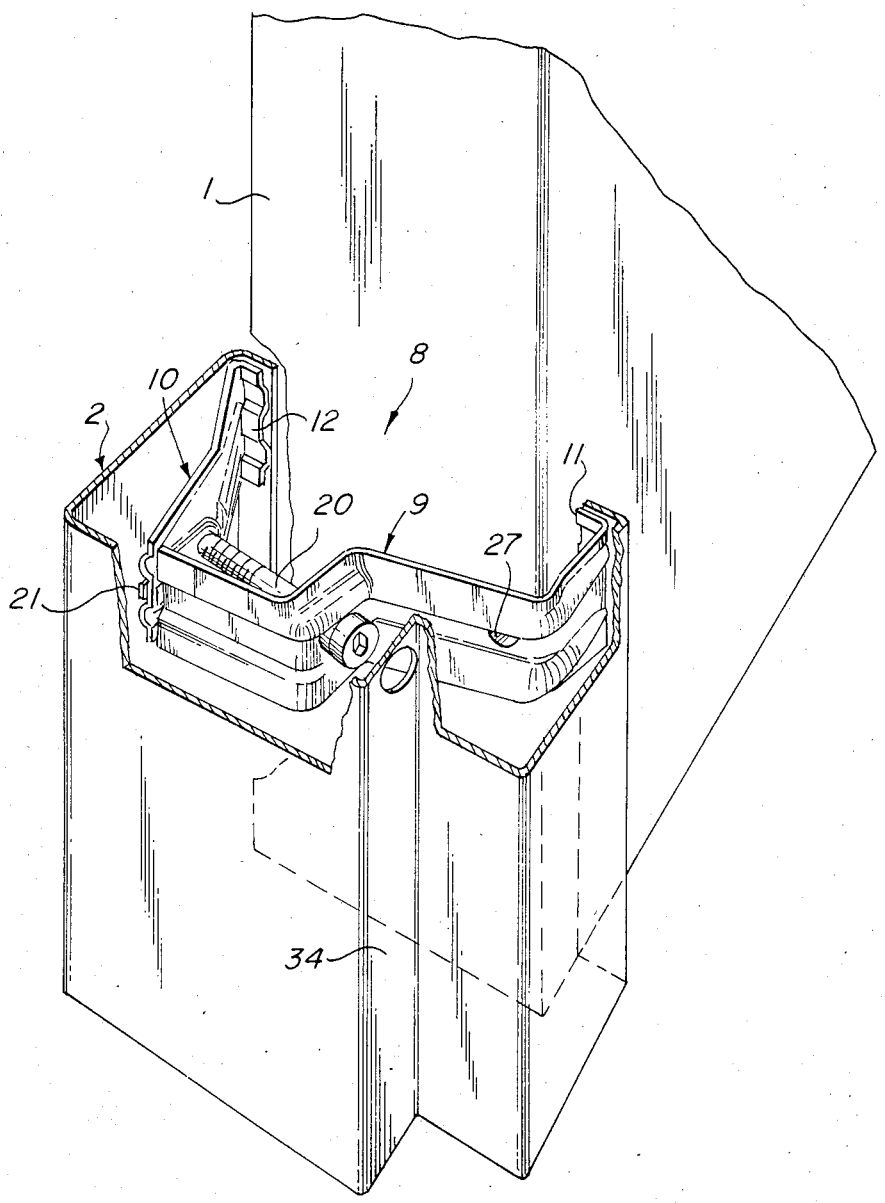
Figure 10:
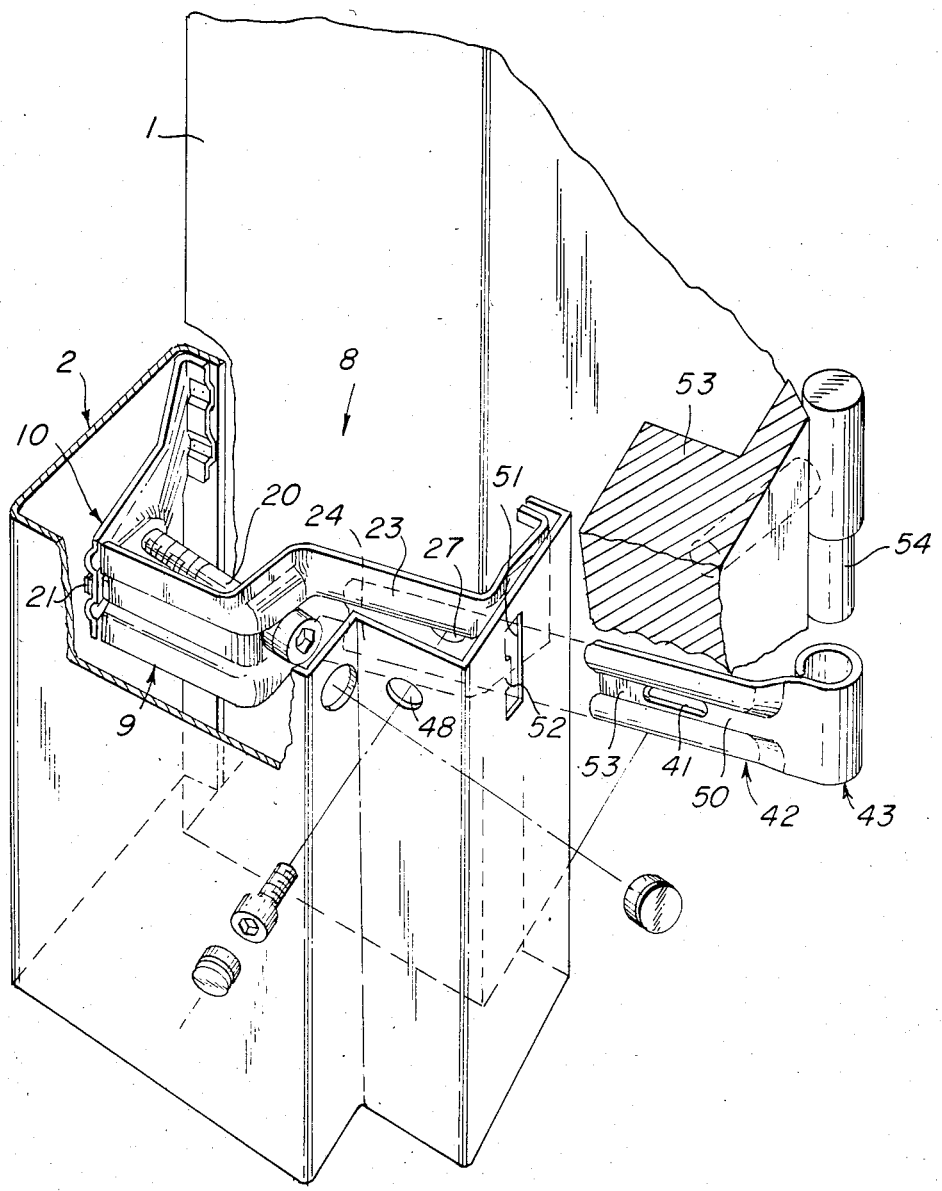

FIG. 1 a cross-sectional view of a frame element embodying the invention mounted in a wall opening, FIG. 2 a plan view of a clamping device of the frame element of FIG. 1, FIG. 3 an elevational view of a clamping jaw of the clamping device of FIG. 2 taken in the direction of the arrows III—III in FIG. 2, FIG. 4 an elevational view of a further clamping jaw of the clamping device of FIG. 2 taken in the direction of hte arrows IV—IV in FIG. 2, FIG. 5 a detail of the clamping device of FIG. 2 illustrating the co-operation between the two clamping jaws, FIG. 6 an enlarged elevational view of the end part of a clamping jaw connected with a flange rim of the profile, FIG. 7 a sectional view taken on the line VII—VII in FIG. 6, FIGS. 8 and 9 two different perspective views of the frame element shown in FIG. 7 in accordance with the invention, FIG. 10 an elevational view like FIG. 9, where a paumelle is arranged on the clamping device, FIGS. 11 to 14 elevational views like FIG. 10 of different frame elements embodying the invention, and FIGS. 15-18 each a sectional view on the line XV—XV and XVIII—XVIII respectively in FIG. 1.

FIG. 1 shows a wall 1, on which is mounted a frame element 40, for example, a jamp or a lintel of a door, said frame element 40 comprising a profile 2 having a substantially U-shaped cross-section. The bottom 3 of the U constitutes the visible side of the profile 2, whereas the limbs of the U constitute flanges 4 and 5, whose rims 6 and 7 clamp a wall rim 1 in between them. The flange rims 6, 7 and the flanges 4, 5 are inwardly bent over and are transverse, preferably perpendicular to the plane 32 of the wall. Inside the profile 2 is arranged a clamping device 8 having two cooperating clampings jaws 9 and 10. The two clamping jaws 9 10 each have a bent-over head rim 11 and 12 respectively, which are welded to the flange rim 6 and 7 respectively of the profile 2 in the factory, at least prior to mounting the frame element 40 to the wall rim 1.

The clamping jaw 9 extends from the head rim 11 by a part 13 along the flange 4 and is prolonged by a part 14 extending in the direction to the bottom 3 of the profile 2, which part is followed by a part 15, which is substantially parallel to the part 13 and is prolonged in a part 16 extending substantially parallel to the bottom 3 of the profile.

The clamping jaw 10 extends from the head rim 12 along substantially the whole flange 5 and has a countersuck portion 17 to which a nut 18 is fastened, for example, welded. Instead of using a nut 27 the clamping jaw 10 may have a tapped hole. The clamping jaw 9 has in the part 15 an opening 19, through which is passed a hollow screw 20, which is screwed into the pressed-in nut 18 and forms part of clamping means drawing the two clamping jaws 9 and 10 towards one another.

The free end of the part 16 of the clamping jaw 9 is provided with a tag 21 which is substantially in line with the part 16 and which grips with a large amount of clearance into an opening 22 near the free end of the clamping jaw 10. Owing to said clearance the tag 21 is displaceable in the opening 22 in a direction transerse of the part 16, whilst the clamping jaws 9 and 10 are pivotable relatively to one another.

The two clamping jaws 9 and 10 are each provided along their two side edges with stiffening ridges 23, 24 and 25, 25 respectively covering substantially the entire length. These stiffening ridges continue along the bent-over head rims 11 and 12 of the two clamping jaws 9 and 10 and have bulging parts 28 in these head rims 11 and 12 to serve as projections in projection welded for establishing the welding junction of these head rims with the associated flange rims 6 and 7 of the profile 2.

FIG. 5 schematically shows a detail of the clamping device 8 illustrating the movabilities of the two clamping jaws 9 and 10 relative to one another. The position of the clamping jaws 9 and 10 indicated by solid lines is occupied when the hollow screw 20 is tightened. The clamping jaws 9 and 10 then turn towards one another about the head rim 33 of the part 16 engaging the clamping jaw 10. The two flanges 4 and 5 are then moved along by the two clamping jaws 9 and 10 and firmly urged with their flange rims 6 and 7 respectively against the side faces 32 of the wall rim 1 so that a satisfactory connection of the frame element 40 is obtained.

Before the frame element 40 is mounted on the wall rim 1 the bolt 20 is loosely screwed into the nut 18 and the two clamping jaws 9 and 10 are relatively movable. If, for example, the wall rim is somewhat thicker the flanges 4 and 5 of the profile 2 must be pushed away one from the other to permit of sliding the profile 2 around the wall rim 1. During this deflection of the flanges 4, 5 the clamping jaw 9 will perform a rotation about the area where the bolt 20 is passed through the opening 19 with an amount of clearance. The part 16 of the clamping jaw 9 will then move in the direction of the arrow R into the position indicated by solid lines. This movability of the clamping jaw 9 with respect to the clamping jaw 10 is limited by the opening 22 in which the tag 21 is engaged. The two clamping jaws 9 and 10 can thus readily move with respect to one another so that the frame element 40 can be arranged around the wall rim 1 with ample clearance and little deformation. The hollow screw 20 can be readily actuated through an opening 29 in a groove 34 of the profile 2, which opening can be closed by means of a rubber plug 30 or a synthetic resin cover.

FIGS. 6 and 7 show a frame element 40 embodying the invention which is particularly effective on smooth and/or shrinkable walls. The head rims 11, 12 of the two clamping jaws 9 and 10 are provided between the spaces 46 formed by the stiffening ridges 25 and 26 with an anchoring plate 31, which slightly projects in the mounted state out of the bent-over head rims 6, 7 of the flanges. The edges 47 of the anchoring plates 1 projecting beyond the head rims 6, 7 may be sharp or serrated. If desired, these anchoring plates 31 may be made from hard steel and be loosely slopped into said spaces so that in the mounted state they slightly penetrate into the wall rim 1 and thus additionally anchor the frame element 40.

Between the two stiffening ridges 23 and 24 the part 14 of the clamping jaw 9 has fastened to it a nut 27. The nut 27 can be constituted by an element welded to a clamping jaw 9 or can be constituted by a part of the clamping jaw 9 having screw tapped hole. For the use illustrated in FIGS. 8 and 9 the nut 27 is not utilized. Yet it is preferred to provide such a nut 27 in order to render the clamping device 8 universally usable, that is to say also for the purpose described hereinafter with reference to FIG. 10.

The nut 27 constitutes a paumelle fastening means for fastening a wing 42 of a paumelle 43. A ridge 50 of the wing 42 of the hinge 43 is enclosed between the two stiffening ridges 23 and 24 and, owing to a slot 41 in the wing 42 of a paumelle 43 it can be adjustably fixed in place in the direction of length of these stiffening ridges by means of a hollow screw 45, which is accessible through a hole 48 in the profile 2 with the aid of a key adapted to the hollow head of the hollow screw 45.

In this way the paumelle 43 is fastened to the rugged clamping device 8 clamping tightly to the wall rim 1 instead of being fastened to the relatively slack metal of the profile 2 so that the forces exerted on the paumelle 43 are transferred through the clamping device 8 to the wall rim 1, as a result of which the load on the profile 2 is reduced and the profile may, if desired, be made from thinner sheet material. The forces exerted on the paumelle 43 are transferred through the tag 21 and the bolt 20 of the clamping jaw 9 to the clamping jaw 10. The tag 21 ensures that the two clamping jaws 9 and 10 will invariably be in the correct relative positions.

The hole 48 can be closed with a synthetic resin cover 49.

The depressed ridge 50 in the middle of the wing 42 of the paumelle imparts rigidity to this wing 42. Moreover owing to the adaptation of this ridge shape of the wing 42 to the gutter shape of the profile 2 of the part 14 of the clamping jaw 9 a firm interengagement of the paumelle 32 and the clamping jaw 9 is ensured.

The wing 42 of the paumelle 43 passes through a passage 51 recessed in the flange 4 and matching the section of the wing 42 which is asymmetrical to rotation. This means that the opening 51 permits only in one position of slipping in the wing 42 from the outside, in which position a cam 52 engages the groove 53 in the wing 42 on the side opposite the ridge 50.

It is thus ensured that the paumelle 43 is invariably fastened in the required position to the clamping device 8 so that a door 53 can be directly and correctly suspended to the paumelle 43 by its hinges 54.

Figure 11:
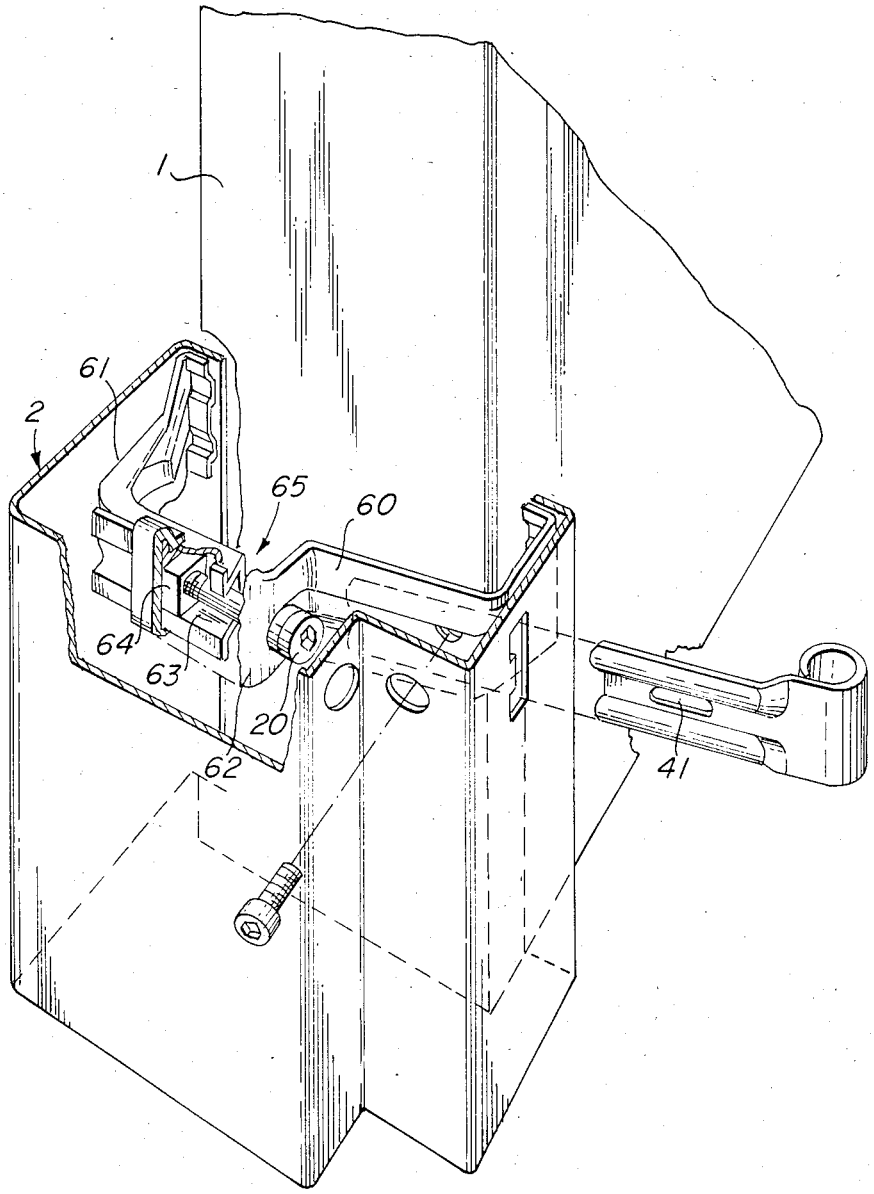

FIG. 11 corresponds with FIG. 10, the difference being that the clamping jaws 60 and 61 are relatively displaceable telescopically by their part 62 and 63. A nut 64 is welded to the part 63 of the clamping jaw 61, whilst the hollow screw 20 is tightened therein to cause the two clamping jaws 60 and 61 to further approach one another when the clamping device 65 is being stretched. These clamping 60 and 61 are made from curved, interengaging steel sheets forming bending-resistant elements.

Figure 12:
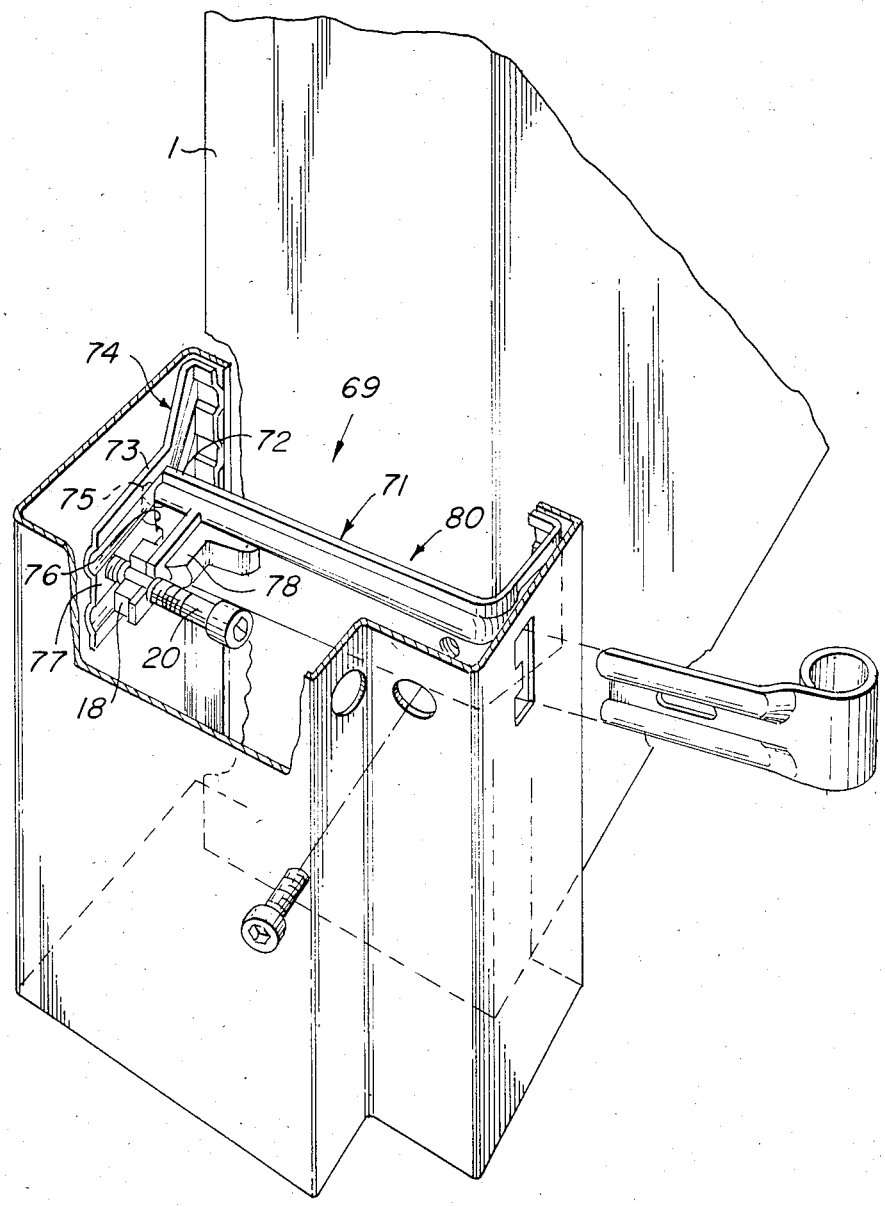

The frame element 69 of FIG. 12 corresponds with that of FIG. 10, the difference being that the clamping jaw 71 pivotally bears by its free end 72 on a central part 73 of the clamping jaw 74 and extends by a hook-like tag 75 through an opening 76 of the central part 73. To the clamping jaw 71 is welded to a console 78 to which is welded a nut 18. The nut 18 with the hollow screw 20 constitutes the means for stretching the clamping device 80, whilst the hollow screw 20 bears on the free end 77 of the clamping jaw 74.

Figure 13:
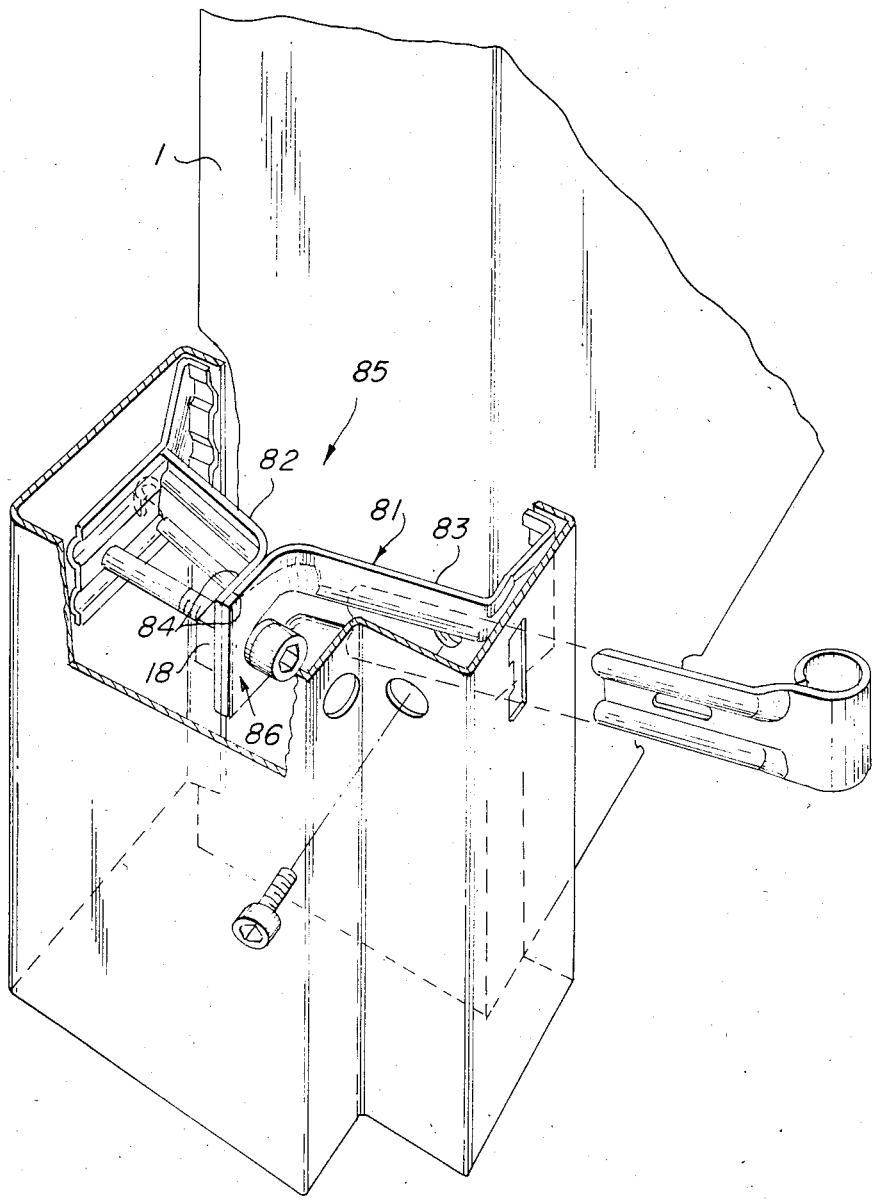

The frame element 85 of FIG. 13 corresponds with that of FIG. 12, the difference being that the clamping jaw 81 consists of two plate portions 82 and 83, which are welded to one another at their free ends 84 after being depressed to form rigid elements for constituting a console 86, to which a nut 18 is welded.

Figure 14:
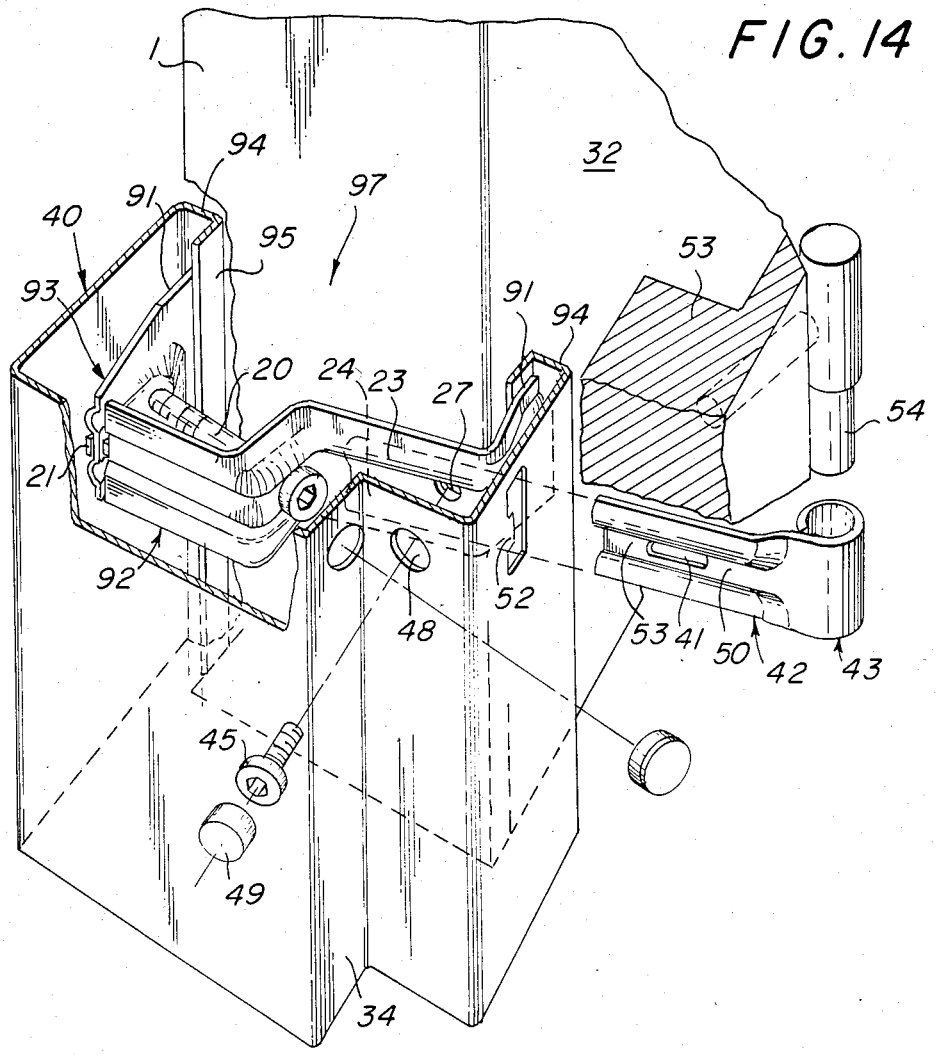
Figure 15:
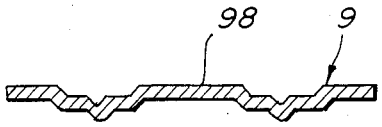
Figure 16:
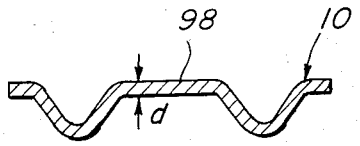
Figure 17:
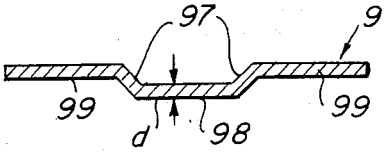
Figure 18:
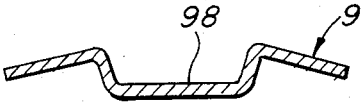

FIG. 14 is distinguished from FIG. 10 in that the head rims 91 of the clamping jaws 92 and 93 are not welded to the flange rims 84. Instead the flange rims 94 each have a bent-over rim 95, which is parallel to the surface 32 of the wall rim 1. When the clamping device 97 is stretched, the head rims 91 of the clamping jaws 92 and 93 clamp the bent-over rims 95 against the wall rim 1 so that the frame element 40 is tightly clamped to the wall rim 1.

The sectional views XV to XVIII show a profile of the clamping jaws 9 and 10 in which upright gutter sides 97 of a gutter profile 98 adjoin flanges 99 so that each clamping jaw 9, 10 derives its rigidity despite the small thickness of the material mainly from said gutter profile 98. The flanges 99 may have downwardly bent-over rims. The clamping jaws 9, 20 are preferably made from high-grade steel so that with a heavy stamping force they can just be bent and profiled. The process of profiling with heavy stamping force increases highly the rigidity of the material so that the clamping jaws 9, 10 become very rigid. As an alternative, after their formation the clamping jaws may be subjected to a hardening process. The thickness d of the material of the clamping jaws 9, 10 is preferably less than 2 mms.

What I claim is:

1. A frame comprising:

a steel frame element having a substantially u-shaped cross-section, a first opening means, at least one other opening means and two flanged rim means for clamping a wall in between the flanged rim means;

at least one clamping device having steel clamping jaws positioned within said frame element, one of said jaws being provided with a paumelle fastening means;

clamping means for connecting said clamping jaws;

said clamping jaws having a substantially ridge and gutter shaped profile along the longitudinal direction of the clamping jaws, said clamping jaws engaging said flanged rim means;

at least one paumelle having a wing portion thereon which is provided with a paumelle fastening means, along said wing portion, for attaching said wing with one of said clamping jaws, said wing being engaged with said clamping jaws through said first opening means, said wing shaped so as to securely fit within the ridge and gutter shape of said clamping jaw; and a single screw bolt means being passed through said other opening means, for attaching said wing to one of said clamping jaws.

2. The frame according to claim 1, wherein the first opening means has an asymmetrical section upon rotation as viewed in the direction of insertion, said opening means being adapted to allow said wing to pass therethrough.

3. The frame as claimed in claim 1, wherein the clamping device is provided with anchoring means for penetrating into at least one wall surface of the wall rim.

4. The frame as claimed in claim 1, wherein the anchoring means further comprises an anchoring plate enclosed between a flange rim means of the frame element and a head rim of a clamping jaw.

5. The frame as claimed in claim 1, wherein the two clamping jaws hook one into the other so as to be relatively displaceable.

6. The frame according to claim 1, wherein the flanged rim means are welded to the clamping jaws.

7. The frame according to claim 1, wherein the paumelle fastening means on said wing is slot shaped.

8. The frame according to claim 1, wherein the frame element and the clamping jaws are made of steel.

* * * * *